US007464789B2

(12) United States Patent
Yamamoto et al.

(10) Patent No.: US 7,464,789 B2
(45) Date of Patent: Dec. 16, 2008

(54) EXHAUST SILENCER FOR INTERNAL COMBUSTION ENGINE

(75) Inventors: Kazuo Yamamoto, Saitama (JP); Kihoko Kaita, Saitama (JP); Kazuhiro Yasuda, Saitama (JP); Hiroaki Koishi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 381 days.

(21) Appl. No.: 10/792,874

(22) Filed: Mar. 5, 2004

(65) Prior Publication Data

US 2004/0178016 A1 Sep. 16, 2004

(30) Foreign Application Priority Data

Mar. 10, 2003 (JP) ..... 2003-063102

(51) Int. Cl.
*F01N 1/10* (2006.01)

(52) U.S. Cl. ..... 181/256; 181/258; 181/252; 181/212; 181/222

(58) Field of Classification Search ..... 181/256, 181/258, 247, 252, 222, 212, 231, 227, 249, 181/255, 254
See application file for complete search history.

(56) References Cited

U.S. PATENT DOCUMENTS

| | | | | | |
|---|---|---|---|---|---|
| 2,448,382 | A * | 8/1948 | Mason | 89/14.4 |
| 2,995,199 | A * | 8/1961 | Myers | 181/256 |
| 3,690,606 | A * | 9/1972 | Pall | 428/605 |
| 3,710,891 | A * | 1/1973 | Flugger | 181/256 |
| 3,783,969 | A * | 1/1974 | Pall | 181/286 |
| 3,984,054 | A * | 10/1976 | Frochaux | 239/424 |
| 4,278,147 | A * | 7/1981 | Watanabe et al. | 181/256 |
| 5,166,479 | A * | 11/1992 | Gras et al. | 181/256 |
| 5,627,351 | A * | 5/1997 | Okuma et al. | 181/231 |
| 5,633,482 | A * | 5/1997 | Erion et al. | 181/282 |
| 5,726,397 | A * | 3/1998 | Mukai et al. | 181/232 |
| 5,902,956 | A * | 5/1999 | Spies et al. | 174/358 |
| 5,992,560 | A * | 11/1999 | Matsuoka et al. | 181/252 |
| 6,230,748 | B1 * | 5/2001 | Krawietz et al. | 138/121 |
| 6,354,398 | B1 * | 3/2002 | Angelo et al. | 181/256 |
| 6,699,540 | B1 * | 3/2004 | Tsukamoto | 428/34.1 |
| 2003/0019688 | A1 * | 1/2003 | Takewaka et al. | 181/252 |
| 2003/0118762 | A1 * | 6/2003 | Brown et al. | 428/36.1 |
| 2003/0136607 | A1 * | 7/2003 | Kawamata et al. | 181/231 |
| 2004/0256174 | A1 * | 12/2004 | Friou | 181/258 |

FOREIGN PATENT DOCUMENTS

| | | | |
|---|---|---|---|
| JP | 54-21733 | * | 2/1979 |
| JP | 59-135323 U | * | 9/1984 |

* cited by examiner

*Primary Examiner*—Walter Benson
*Assistant Examiner*—Forrest M Phillips
(74) *Attorney, Agent, or Firm*—Birch, Stewart, Kolasch & Birch, LLP

(57) ABSTRACT

A high-performance exhaust silencer in which a shell wall includes a shell outer plate, a shell inner plate, and a damping material to be inserted therebetween. A space between the shell outer plate and shell inner plate of the exhaust silencer is narrowed and the shell outer plate and the shell inner plate will not interfere with each other. An outer shape of the exhaust silencer is small but the expansion chambers are large by providing an air space between the shell outer plate and the shell inner plate. For the above-mentioned damping material, a material obtained by stretchably weaving metal wire into mesh is used.

24 Claims, 9 Drawing Sheets

EXHAUST SILENCER FOR INTERNAL COMBUSTION ENGINE

CROSS-REFERENCE TO RELATED APPLICATIONS

The present non-provisional application claims priority under 35 USC 119 to Japanese Patent Application No. 2003-063102 filed on Mar. 10, 2003 the entire contents thereof is hereby incorporated by reference.

BACKGROUND OF THE INVENTION

1. Field of the Invention

The present invention relates to an exhaust silencer for a four-stroke internal combustion engine adapted to be mounted on a vehicle such as a motorcycle.

2. Description of Background Art

In a conventional exhaust silencer, a shell wall is fabricated by pressing and attaching wire cloth of a damping material to the inner side of a shell outer plate with a shell inner plate made of a punching plate. Since the wire cloth is relatively thick, it is necessary to widen a space between the shell outer plate and the shell inner plate. Thus, a problem occurs in that the exhaust silencer becomes larger.

Moreover, in the above-mentioned method of attaching the damping material, a temporarily attaching process is necessary by using tape, spot welding or the like. Thus, a problem occurs in that the number of man-hours for assembly are increased.

Unexamined Utility Model Application Publication No. S61-94223 discloses a conventional exhaust silencer.

SUMMARY AND OBJECTS OF THE INVENTION

An object of the present invention is to provide a high-performance exhaust silencer which solves the above-mentioned problems of the prior art, narrows the space between the shell outer plate and shell inner plate of the exhaust silencer and allows the shell outer plate and the shell inner plate not to interfere with each other. In addition, the exhaust silencer has a small outer shape but a large combustion chamber by providing an air space between the shell outer plate and the shell inner plate.

Further, another object is to improve a damping material to be inserted between the shell outer plate and the shell inner plate as well as an improved attaching method thereof. Thus, an improvement in the working efficiency is provided.

The present invention is one which solves the above-mentioned problems by providing an exhaust silencer for an internal combustion engine in which a shell wall includes a shell outer plate, a shell inner plate and a damping material to be inserted therebetween. The above-mentioned damping material is a material obtained by stretchably weaving metal wire into mesh.

In the present invention, since the material is made by weaving metal wire into mesh that is used as the damping material and therefore stretchable, the damping material can be inserted with a thin thickness, whereby it becomes possible to make the shell wall thinner. Further, since an air space can be provided between the shell outer plate and the shell inner plate, it is possible to provide an exhaust silencer having a small outer shape with a large combustion chamber. That is, it is possible to prevent the shell wall of the exhaust silencer from vibrating, without reducing the capacity of the exhaust silencer while suppressing an increase in the weight thereof. The shell outer plate can be thermally insulated with air spaces in the mesh.

The present invention may utilize a metal wire that is a stainless steel wire. Thus, the heat-resistance properties of the damping material can be improved.

The present invention provides an exhaust silencer for an internal combustion engine wherein both the shell inner plate and the damping material are of a woven mesh that are fabricated into cylindrical shapes. The damping material of the woven mesh material is fabricated so that an inner diameter thereof is smaller than an outer diameter of the shell inner plate on natural length scales.

When the damping material is fabricated as described above and is extended in a diameter direction by utilizing the stretchability of the cylindrical mesh, placed over the shell inner plate, and thereafter pulled in a longitudinal direction and contracted in the diameter direction, the damping material comes into tight contact with the shell inner plate. Since a temporary attachment by using tape or temporary attachment by spot welding like in a conventional method is not necessary, the working is facilitated, and the working efficiency is improved. Moreover, since the shell inner plate is tightly squeezed, a damping effect is also obtained.

The present invention provides an exhaust silencer for an internal combustion engine wherein the damping material is woven using a bundle of a plurality of metal wires.

The strength of the damping material is increased by bundling the plurality of metal wires. Moreover, thermal-insulation properties are increased due to air spaces retained between the plurality of metal wires. Furthermore, the damping material with an adequate thickness can be obtained by changing the number of the wires to be bundled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 9:
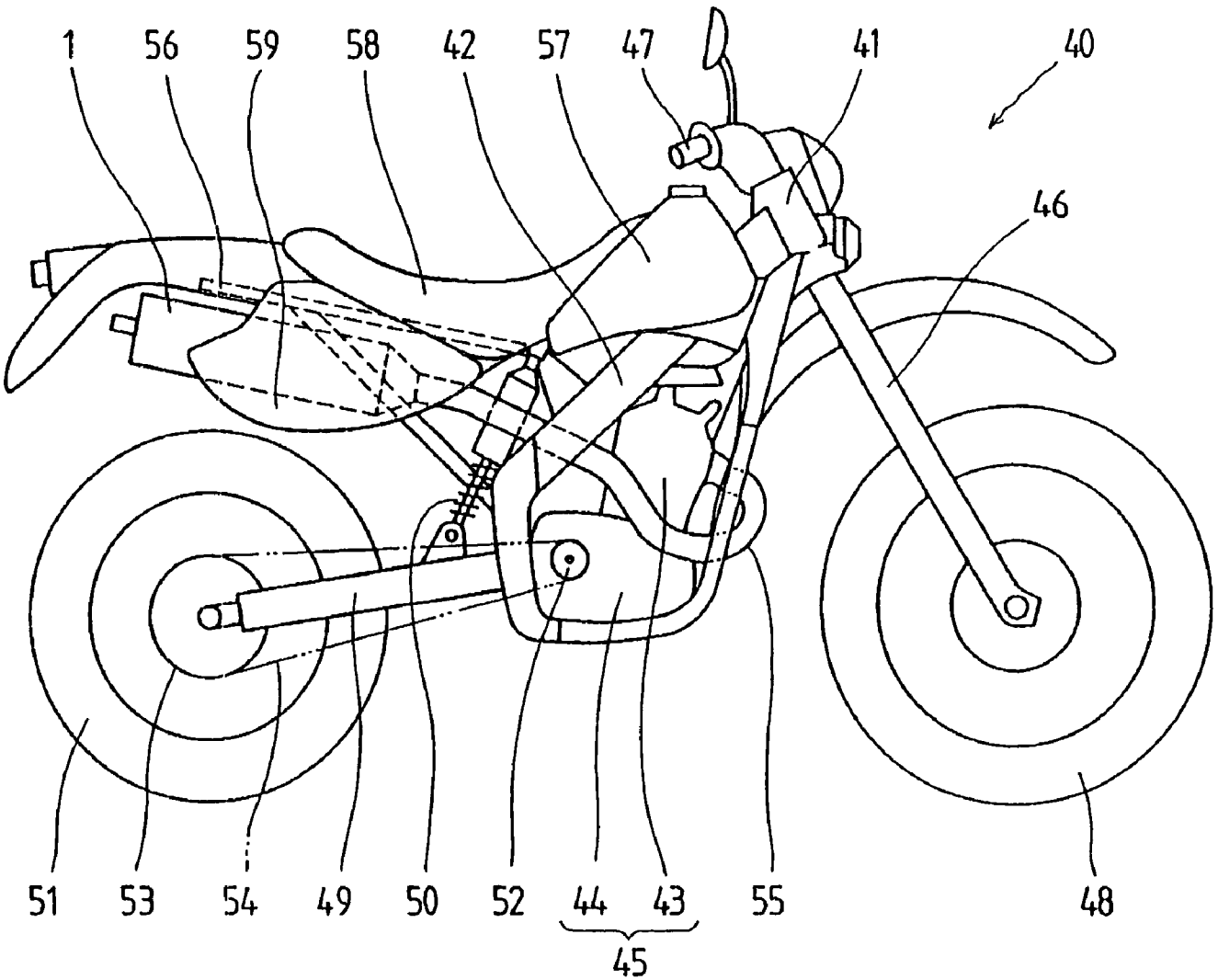
FIG. 9 is a side view of a motorcycle equipped with an exhaust silencer of the present invention.

FIG. 9 is a side view of a motorcycle 40 equipped with an exhaust silencer 1 of the present invention. Across the center of a body frame 42 that continues to a head pipe 41 of this motorcycle, a power unit 45 is mounted that includes an internal combustion engine 43 and a transmission 44. The body frame 42 is constituted by connecting a plurality of members. A front fork 46 is rotatably supported by the head pipe 41, and the shaft of a handlebar 47 and the axle of a front wheel 48 are supported by the upper and lower ends of the front fork 46, respectively. The front end of a rear fork 49 is pivotally supported by a rear portion of the body frame 42 and is capable of rocking in a vertical direction. A shock absorber 50 is positioned between the rear fork 49 and the body frame 42. The axle of a rear wheel 51 is supported by the rear end of the rear fork 49. The rear wheel 51 is driven by a chain 54, which is wound around a drive sprocket 52 attached to a shaft end of an output shaft of the power unit 45. A driven sprocket 53 is attached to the axle of the rear wheel 51. The output shaft is disposed in a crosswise direction of the body, in parallel with a crankshaft and the like. An exhaust pipe 55, is connected to an exhaust port provided at the front side of the internal combustion engine 43, that leads around the right side of the body to a rear portion of the body, where the exhaust pipe 55 is connected to the front end of the exhaust silencer 1. The exhaust silencer 1 is mounted across a seat rail 56 with the front end being connected to the body frame 42 and the distal end extending rearwardly. A fuel tank 57 is installed on an upper portion of the body frame 42. A seat 58 is mounted on an upper portion of the seat rail 56. A side cover 59 is mounted on the body frame.

Figure 10:
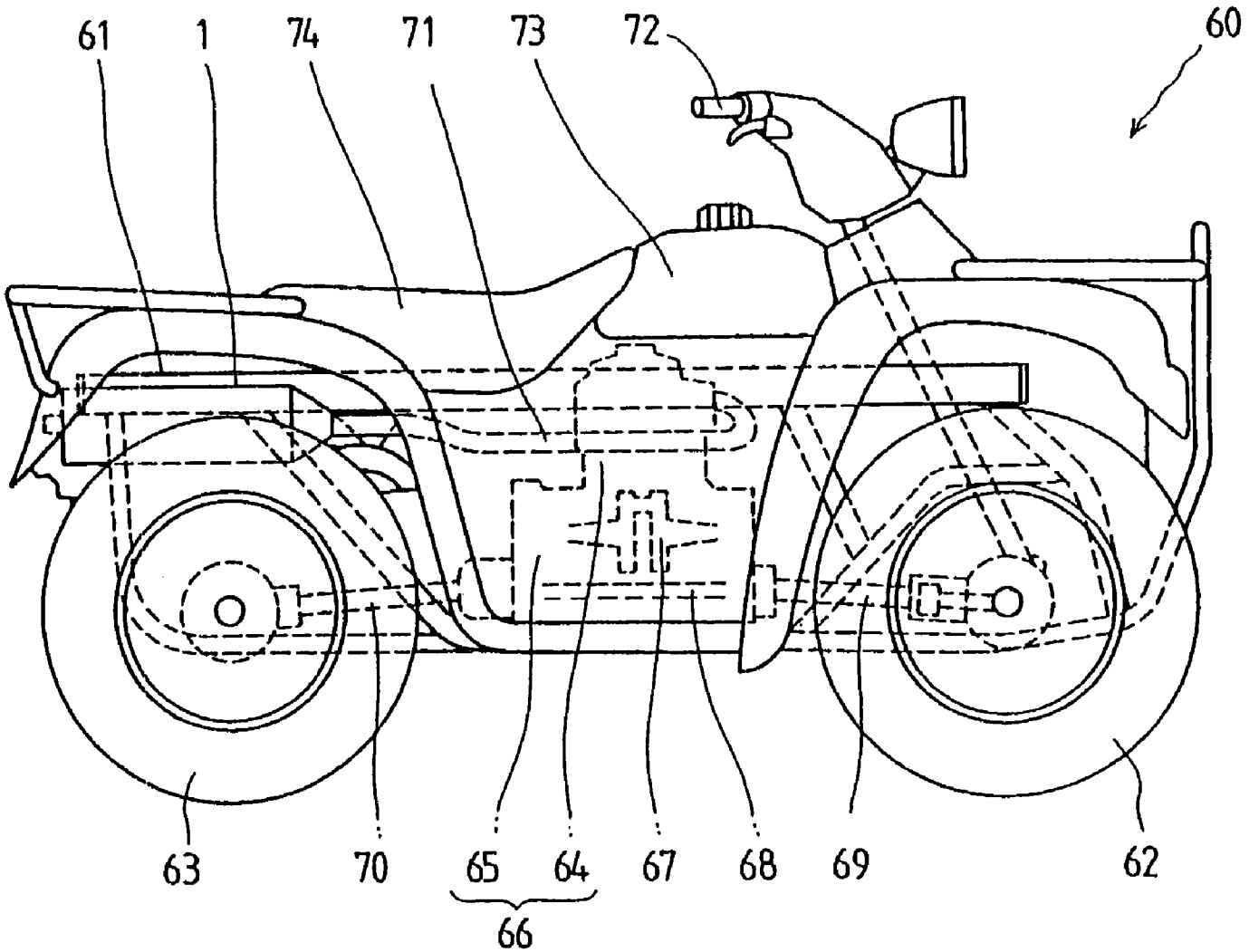
FIG. 10 is a side view of a four-wheel buggy equipped with an exhaust silencer of the present invention.

FIG. 10 is a side view of a four-wheel buggy (rough-terrain vehicle of a saddle-riding type) 60 equipped with the exhaust silencer 1 of the present invention. The buggy 60 includes a pair of right and left wheels 62 and a pair of right and left rear wheels 63 at the front and rear of a body frame 61, respectively. A power unit 66 is provided in which an internal combustion engine 64 and a transmission 65. The power unit 66 is supported by a center portion of the body frame 61. The power unit 66 is arranged so that a crankshaft 67 is oriented in a longitudinal direction of a body. The rotation of the crankshaft 67 is transmitted to an output shaft 68 through each shaft of the transmission 65. Each of these shafts is parallel with the crankshaft 67 and arranged to be oriented in the longitudinal direction of the body. The front wheels 62 is driven by a front wheel drive shaft 69 connected to the front end of the output shaft 68. The rear wheels 63 are driven by a rear wheel drive shaft 70 connected to the rear end of the output shaft 68. An exhaust pipe 71, connected to an exhaust port is provided at the front side of the internal combustion engine 64, and extends around a side of the internal combustion engine 64 to a rear portion of the body, where the exhaust pipe 71 is connected to the front end of the exhaust silencer 1. The exhaust silencer 1 is mounted across the body frame 61, between the body frame 61 and the rear wheels 63. On an upper portion of the body, a handlebar 72, a fuel tank 73, and a seat 74 are mounted in that order from the front.

Figure 1:
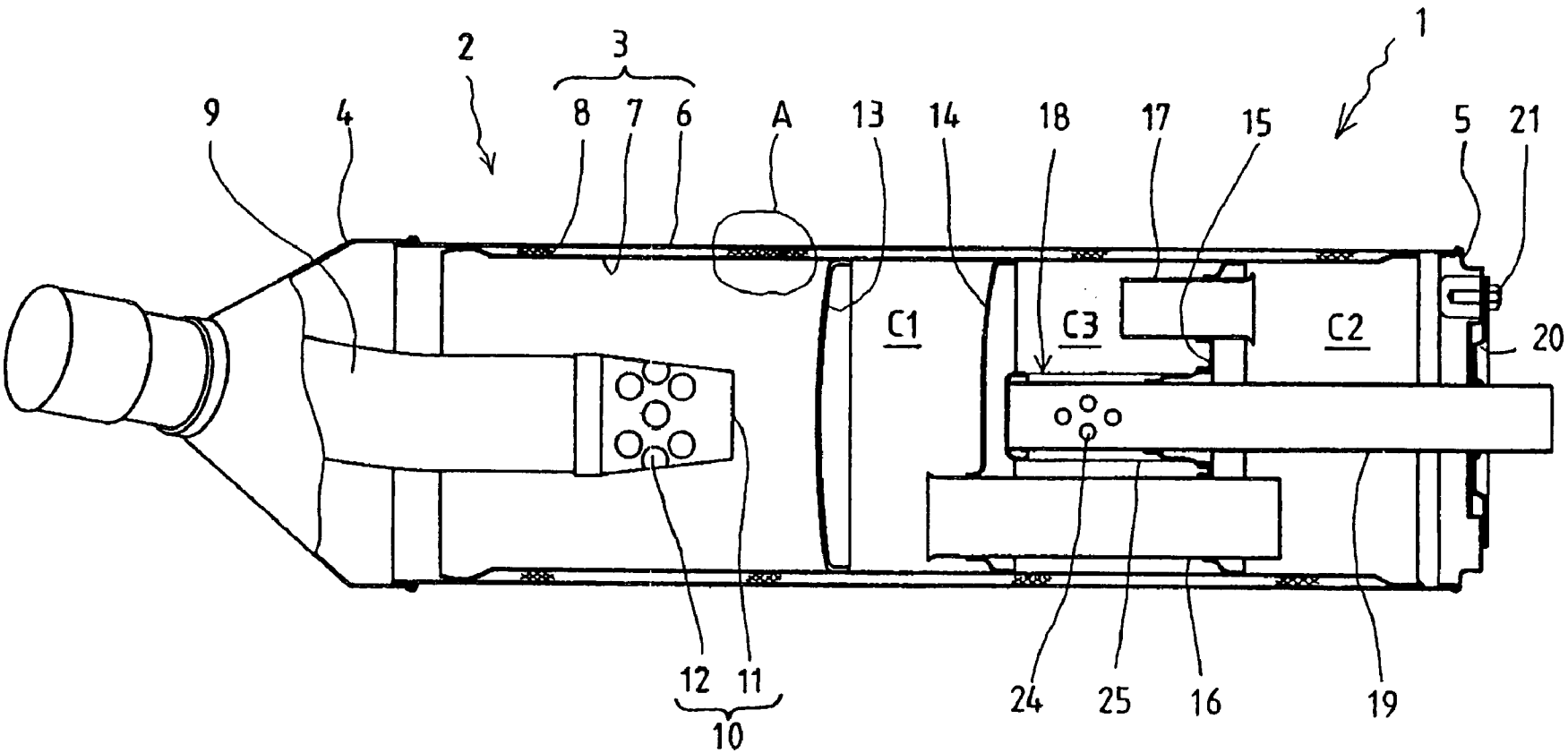
FIG. 1 is a longitudinal section of an exhaust silencer according to an embodiment of the present invention.

FIG. 1 is a longitudinal section of the exhaust silencer 1 according to a first embodiment of the present invention. The exhaust silencer is adapted to be connected to an exhaust pipe of a four-stroke internal combustion engine for a motorcycle or a four-wheel buggy. In the drawing, a shell 2 of the exhaust silencer includes a shell cylinder part 3, a conical front cap 4, and a rear end plate 5 having a large opening at a center portion thereof. The shell cylinder part 3 includes a shell outer plate 6, a shell inner plate 7, and a damping material 8 mounted therebetween. An introducing pipe 9 adapted to be connected to the exhaust pipe of the internal combustion engine penetrates a top portion of the front cap 4. An exhaust gas ejecting inlet 10 at the tip of the introducing pipe 9 opens inside the shell. The exhaust gas ejecting inlet 10 has a tip opening 11 of the introducing pipe 9 and a plurality of small holes 12 bored in the side face at a tip portion of the introducing pipe 9, so that ejected gases are dispersed into the surroundings.

Inside the shell inner plate, a punching metal partition 13, a first separator 14, and a second separator 15 are provided in that order from the front. A first expansion chamber C1 is provided in a portion before the first separator 14. A second expansion chamber C2 is provided in a portion after the second separator 15. A third expansion chamber C3 is provided in a portion sandwiched between the first separator 14 and the second separator 15. The ordinal numbers "first" to "third" for the expansion chambers agree with the passing order of exhaust gases. The punched metal partition 13 is a sheet metal partition plate perforated with a plurality of small hole, through which the gases can freely pass. The partition 13 is for equalizing the rate of exhaust gases in the first expansion chamber C1, and thus preventing the retention of the gases.

A first communication pipe 16, penetrates through both the first separator 14 and the second separator 15 and is fixed to the separators. A second communication pipe 17, penetrates through the second separator 15 only and is fixed to the second separator 15. Exhaust gases are permitted to flow from the first expansion chamber C1 to the second expansion chamber C2 through the first communication pipe 16, and further to flow from the second expansion chamber C2 to the third expansion chamber C3 through the second communication pipe 17. It is possible to provide two first communication pipes 16 which may be provided, with positional relationships similar to each other relative to the shell center line.

A spark arrester 18 is mounted that penetrates through the first separator 14, the second separator 15 and the rear end plate 5. The spark arrester 18 is mounted by fixing a flange 20, which is welded to a rear end portion of a tail pipe 19 that is a core portion of the spark arrester 18, to the rear end plate 5 with a bolt 21.

Figure 2A:
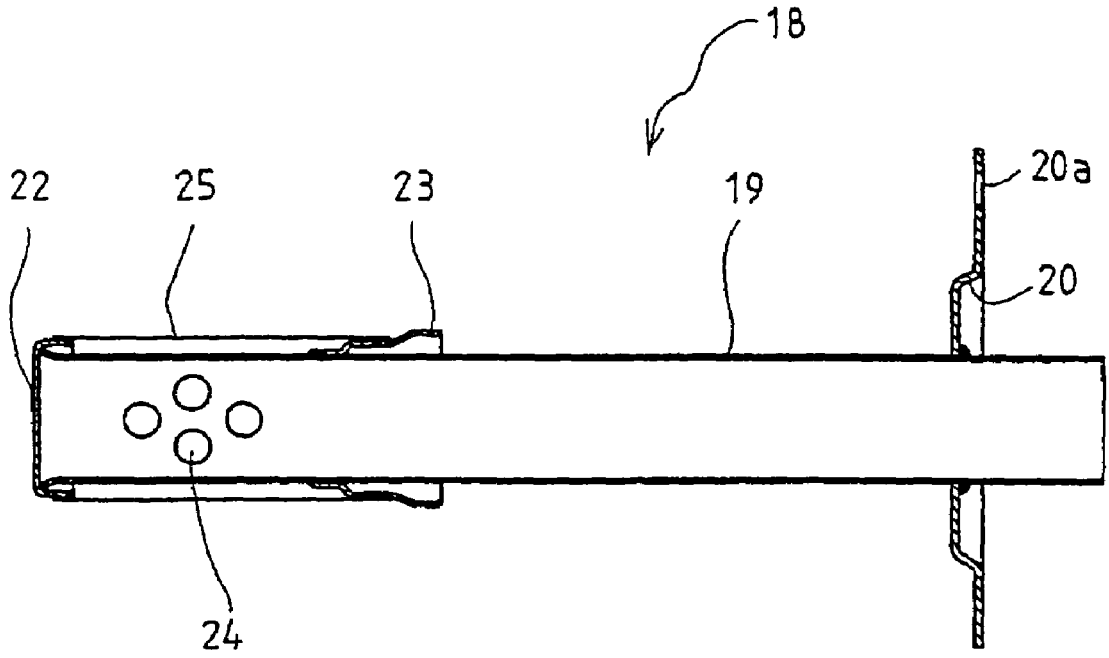
FIGS. 2(*a*) and 2(*b*) are views of a spark arrester in use for the exhaust silencer, where FIG. 2(*a*) is a longitudinal section thereof and FIG. 2(*b*) is a view viewed from the rear thereof.
Figure 2B:
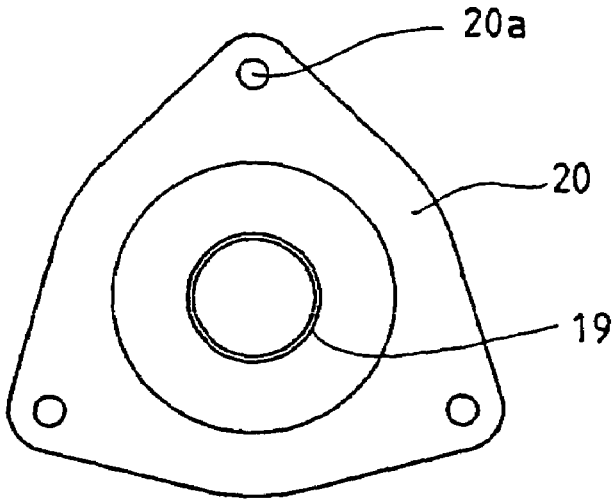

FIGS. 2(*a*) and 2(*b*) are views of the spark arrester 18, where FIG. 2(*a*) is a longitudinal section thereof, and FIG. 2(*b*) is a view viewed from the rear thereof. To the tail pipe 19 that is the core thereof, a tail pipe front cap 22, a supporting ring 23, and the flange 20 are welded in that order from the front. The side face at a front end portion of the tail pipe 19 is perforated with a plurality of gas-inflow small hole 24. Between the side faces of the tail pipe front cap 22 and of the supporting ring 23, a spark catching wire mesh 25 made of stainless steel for preventing sparks and soot from flowing out, is positioned and spot-welded thereto.

In the exhaust silencer shown in FIG. 1, exhaust gases which have been discharged from the unillustrated internal combustion engine and, through the introducing pipe 9, ejected into the shell 2 of the exhaust silencer, travel though the first expansion chamber C1, the first communication pipe 16, the second expansion chamber C2, the second communication pipe 17, the third expansion chamber C3, the spark catching wire mesh 25, the gas-inflow small holes 24, the tail pipe 19, and are discharged out to the atmosphere. Through a process in which the exhaust gases repeat an expansion and contraction by alternately pass through the expansion chambers with each having a large capacity and through the long communication pipes, the gas pressure of the exhaust gases is reduced and also the noise thereof is deadened. The exhaust gases are purified through the spark catching wire mesh 25, and discharged from the rear end of the tail pipe 19.

Figure 3:
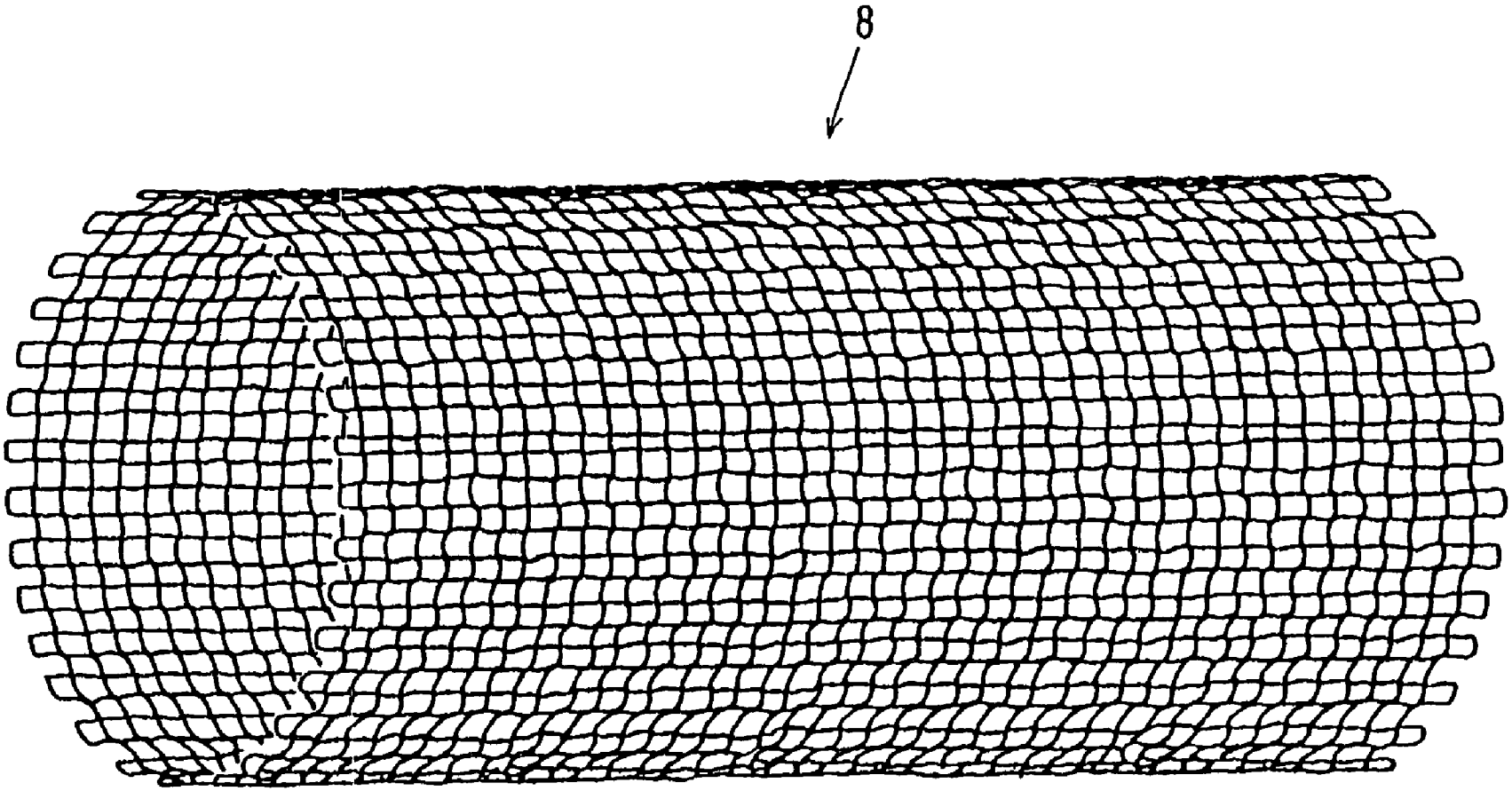
FIG. 3 is an outside view of wire mesh woven from stainless steel wire into a cylindrical shape.
Figure 4:
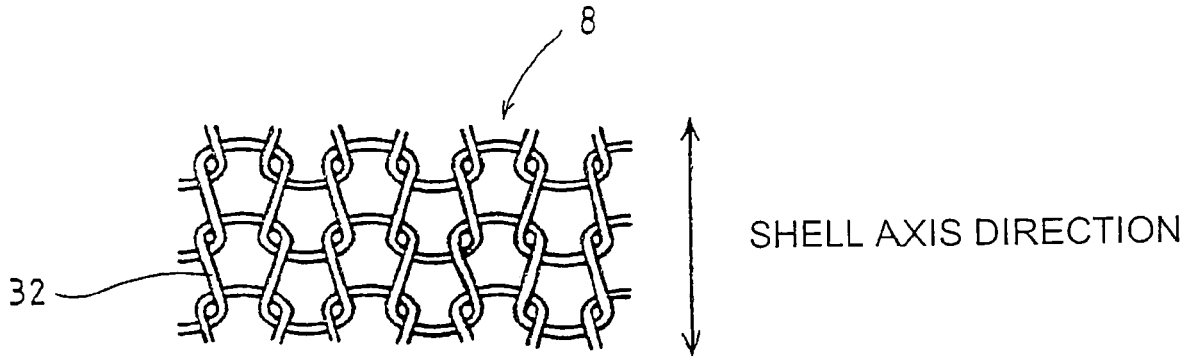
FIG. 4 is a partially enlarged view of the cylindrical wire mesh.
Figure 5:
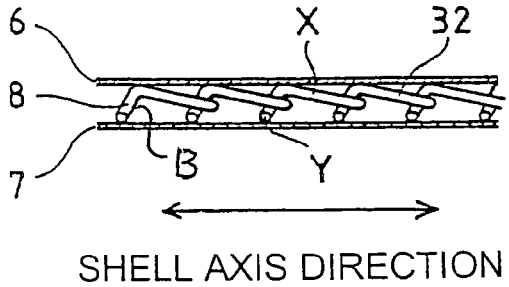
FIG. 5 is an enlarged sectional view of a shell wall (portion A in FIG. 1) in the embodiment.

FIG. 3 is an outside view of the damping material 8 which is mounted between the shell outer plate 6 and the shell inner plate 7. The wire mesh is made stretchable by weaving stainless steel wire into a cylindrical shape. FIG. 4 is a partially enlarged view of the cylindrical wire mesh. The arrow indicates an axis direction of the silencer shell on which this wire mesh is to be mounted. Although a single piece of stainless steel wire 32 of wire mesh may be used, a bundle of a plurality of the stainless steel wires may be handled as if the wire mesh is a single piece of wire that is woven. The cylindrical wire mesh of FIG. 3 is woven in a manner of weaving shown in FIG. 4 so that the whole shape thereof is made cylindrical. The cylindrical wire mesh woven from the stainless steel wire as described above is stretchable in a diameter direction. A variety of methods for weaving the wire mesh may be employed. A mesh density also can be selected from various mesh densities. As another manner of weaving other than the above-mentioned one, a manner may also be used in which, while the direction of a stainless steel wire is slanted on a face of a cylinder relative to a longitudinal direction thereof, the stainless steel wire is woven and finished into a cylindrical shape. FIG. 5 is a longitudinal section of a shell wall (portion A in FIG. 1) on which the wire mesh woven as shown in FIG. 4 is mounted. The arrow indicates the axis direction of the silencer shell.

Procedures for mounting the damping material 8 between the shell outer plate 6 and the shell inner plate 7 are as follows. First, each of the shell outer plate 6, the shell inner plate 7 and the damping material 8 may be constructed in a cylindrical shape. The inner diameter of the damping material is made smaller than the outer diameter of the shell inner plate 7. The cylindrical damping material 8 thus constructed is widen in the inner diameter utilizing the stretchability of its mesh structure, whereby the damping material 8 is put over the outer face of the shell inner plate 7 from one end thereof. After the entire face is finished being covered, an integrated piece of the shell inner plate 7 with the damping material 8 is inserted into a central hollow portion of the shell outer plate 6, and both ends thereof are spot-welded, thus being fixed to each other.

Figure 6:
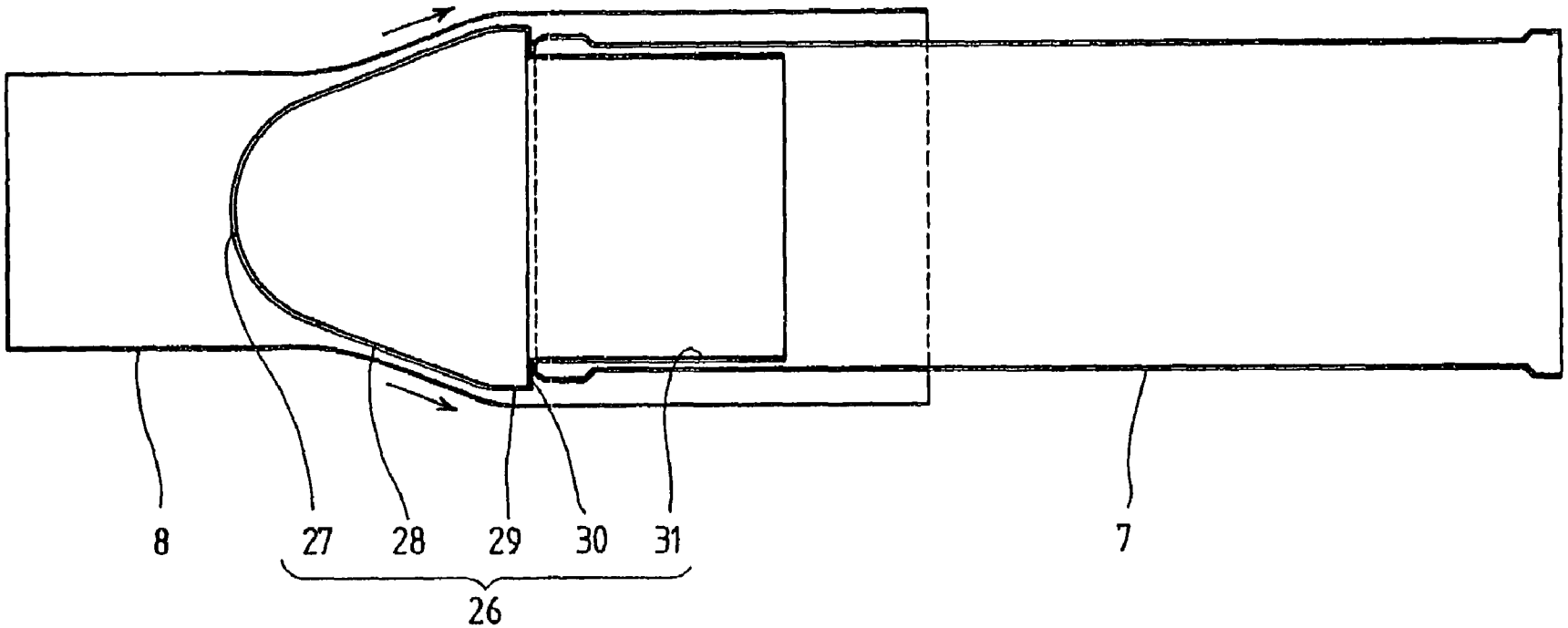
FIG. 6 is a view illustrating the arrangement of putting the cylindrical wire mesh woven from the stainless steel wire over a shell inner plate.

FIG. 6 is a view illustrating the method of putting the damping material 8 of the cylindrical wire mesh woven from the stainless steel wire over the shell inner plate 7. In order to skillfully perform this operation, a wire mesh mounting jig 26 is fitted onto one end of the shell inner plate 7 in a cylindrical shape. The jig 26 is made from a metal plate and that includes a spherical face portion 27 at the tip thereof. A conical face portion 28 is connected to the rear end of the spherical face portion 27. A short cylinder portion 29 is smoothly connected to the rear end of the conical face portion 28. A circular flat plate portion 30 is connected to the rear end of the cylinder portion 29 with a cylinder portion 31 connected to the inner edge side of the circular flat plate portion 30. The cylinder portion 31 is a portion to be fitted inside the one end of the shell inner plate 7. The circular flat plate portion 30 is a portion that is abutted onto the one end of the shell inner plate 7 to serve as a stopper.

When this jig 26 is used, first, the cylindrical damping material 8 having a smaller inner diameter than the outer diameter of the shell inner plate 7, is positioned on the front end of the jig 26 as shown in the drawing and pushed in the direction of the arrows thereafter the damping material 8 is moved while being pushed and is extended in the diameter direction on the surface of the conical face portion 30. The damping material 8 is further moved along the surface of the shell inner plate 7 and mounted thereon. If the damping material 8 is pulled in the axis direction on the surface of the shell inner plate 7, the damping material 8 is contracted in the diameter direction and comes into tight contact with the surface of the shell inner plate 7.

The mesh of stainless steel wire woven into a cylindrical shape by the way of the weaving shown in FIG. 4 has different sliding properties between the surface and in the back face. FIG. 4 is a view of the wire mesh (woven metal mesh) viewed from the surface side thereof. In FIG. 5, the surface side of the wire mesh is illustrated on the top of the drawing, and the back side of the wire mesh is illustrated on the bottom of the drawing. On the surface side of the wire mesh, since the stainless wire 32 is oriented approximately in the shell axis direction as shown at the surface side portions X in FIG. 5, the wire mesh easily slides in the shell axis direction. On the back side, since the stainless steel wire 32 is oriented approximately in a direction orthogonal to the shell axis direction as shown at the back side portions Y in FIG. 5, the wire mesh is harder to slide in the shell axis direction. Bridging portions B extend between the surface side portions X and the back side portions Y, and enable the woven metal mesh to contact both an inner surface of the shell outer plate 6 and an outer surface of the shell inner plate 7. The bridging portions B of the woven metal mesh are oriented approximately in a direction orthogonal to directions of the surface side portions X and the back side portions Y of the woven metal mesh. When the woven metal mesh of the damping material 8 of the embodiment described above is put over the shell inner plate 7, since the mesh is put thereover using the jig 26 shown in FIG. 6 while the inner diameter is extended, the sliding properties do not much matter. However, when a piece obtained by putting the woven metal mesh of the damping material 8 over the shell inner plate 7 is mounted inside the shell outer plate 6, since the piece is inserted therein by allowing the surface of the damping material 8 to slide, good sliding properties are required. Therefore, when weaving the cylindrical wire mesh from the stainless steel wire, it is necessary to weave the wire mesh while taking it into account that the surface side portions X of the wire mesh will be the outer face of the cylindrical damping material.

Figure 7:
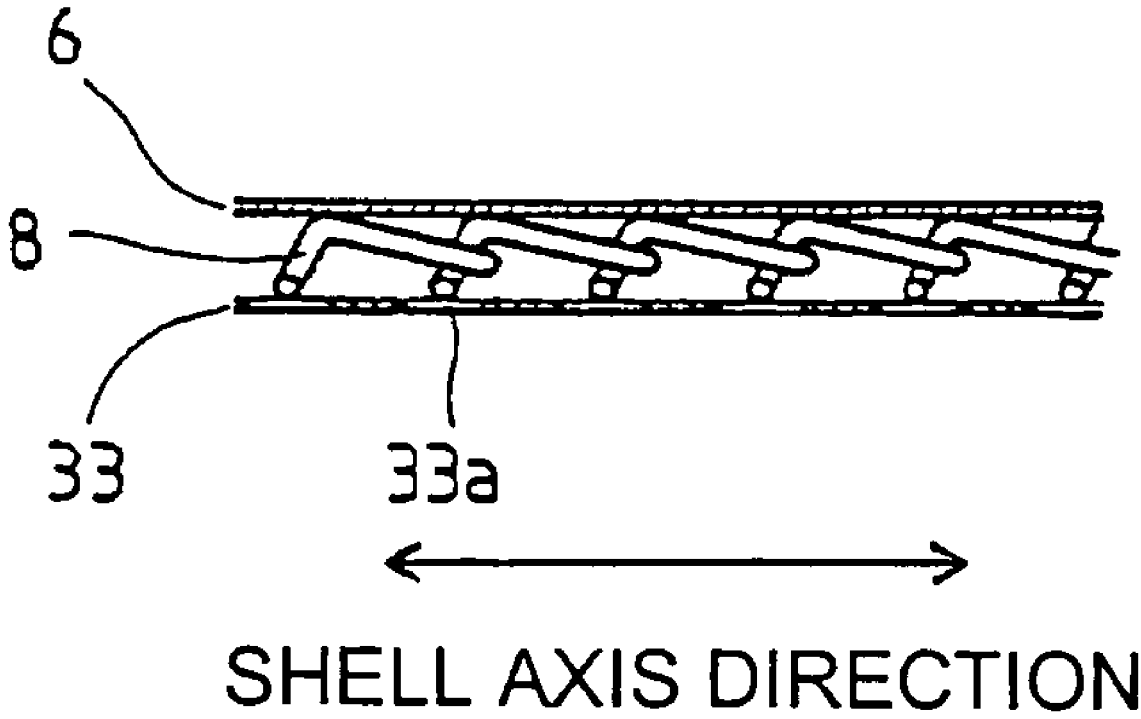
FIG. 7 is an enlarged sectional view of a shell wall in an exhaust silencer according to a second embodiment of the present invention.

FIG. 7 is an enlarged sectional view of a shell wall 3 (portion equivalent to the portion A in FIG. 1) in an exhaust silencer according to a second embodiment of the present invention. In this embodiment, although the shell outer plate 6 and the damping material 8 are the same as those of the above-mentioned first embodiment, the punched metal having a plurality of small hole 33*a* thereon is used for a shell inner plate 33. When such punched metal is used, with a sound absorption effect attributable to air spaces in the mesh of the wire mesh damping material, acoustical properties are produced in the shell wall of the exhaust silencer. Configurations other than the above-mentioned part are the same as that of the exhaust silencer 1 of the first embodiment.

Figure 8:
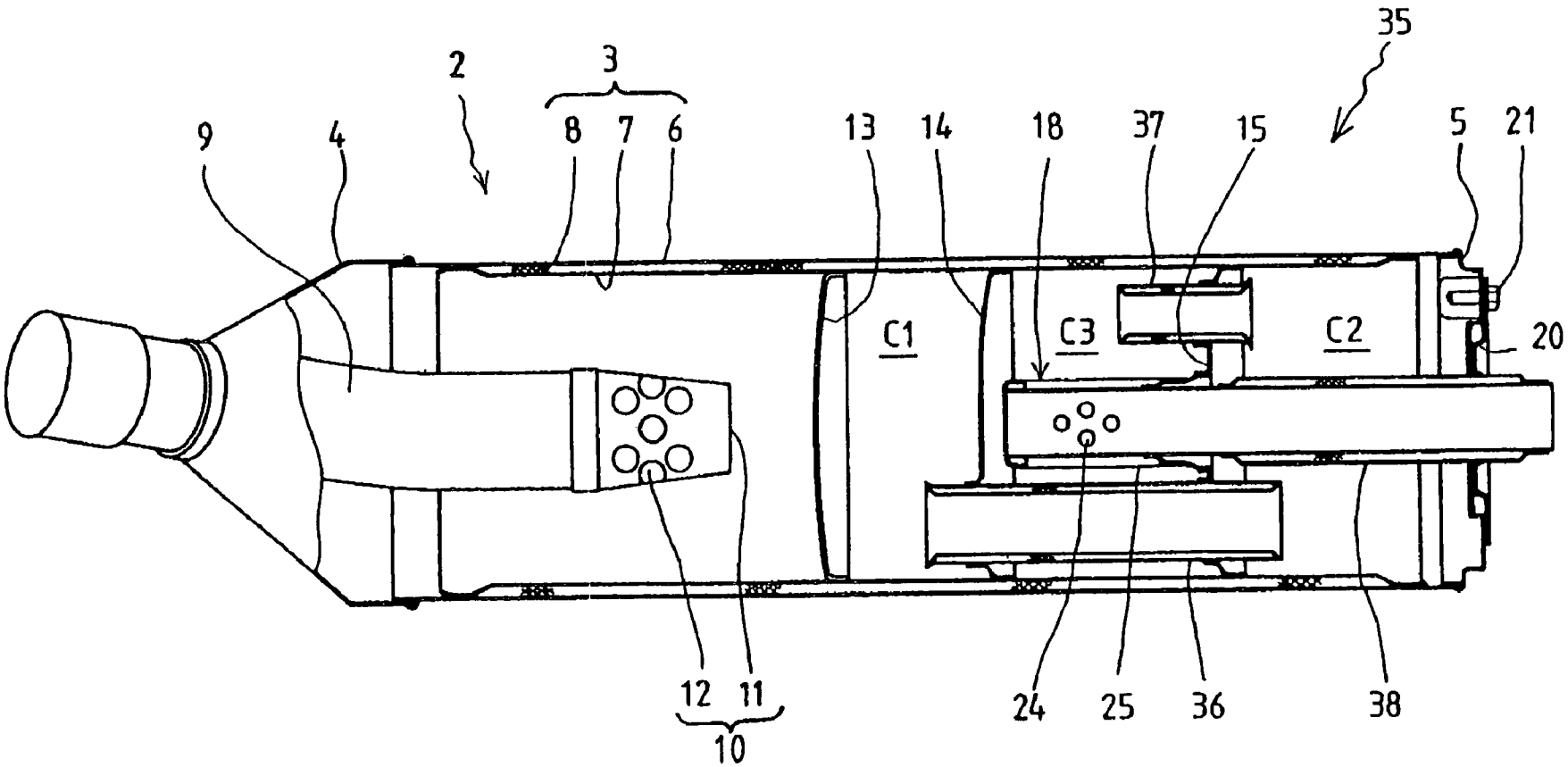
FIG. 8 is a longitudinal section of an exhaust silencer according to a third embodiment of the present invention.

FIG. 8 is a longitudinal section view of an exhaust silencer 35 according to a third embodiment of the present invention.

In FIG. 8 the damping structure used for the shell walls of the above-mentioned first and second embodiments is used as a damping structure for other parts, where outlet portions of a first communication pipe 36, a second communication pipe 37 and a tail pipe 38 are each of a double-wall structure. Between the double walls, the cylindrical wire mesh which is woven from stainless steel wire and used in the above-mentioned embodiments is mounted to thereby prevent the vibration of the pipes. Since parts other than the above are the same as that of the exhaust silencer 1 of the first embodiment, corresponding members are designated by the same reference symbols and numerals.

Hereinbefore, the various embodiments have been described in detail. Each of the embodiments is to be connected to an exhaust pipe of a motorcycle or of a four-wheel buggy as shown in FIGS. 9 and 10, respectively, or other engines that require an exhaust silencer. In the present invention, since the cylindrical wire mesh is made by weaving a metal wire is used as a damping material, it is possible to prevent the shell wall of the exhaust silencer from vibrating, without reducing the capacity of the exhaust silencer but still suppressing an increase in the weight thereof. Moreover, it is possible to thermally insulate the shell outer plate with air spaces in the mesh. Since stainless steel wire is used as a material for the damping material, heat-resistance properties of the damping material are high.

When the damping material is mounted, the damping material extends in the diameter direction by utilizing the stretchability of the damping material formed into cylindrical mesh, positioned over the shell inner plate, and after being positioned thereover, pulled in the longitudinal direction, and contracted in the diameter direction, whereby the damping material comes into tight contact with the shell inner plate. Accordingly, since it is not necessary to use a temporary attachment by using tape or temporarily attaching by spot welding like in a conventional exhaust silencer, the assembly is facilitated and efficiency is improved. Moreover, since the shell inner plate is tightly squeezed, a damping effect is also obtained.

When the wire mesh is woven from a bundle of a plurality of metal wires as a material, the strength of the damping material is increased. Moreover, thermal-insulation properties are increased due to air spaces retained between the plurality of metal wires. Furthermore, by changing the number of the wires to be bundled, it is possible to obtain the damping material with an appropriate thickness. The above-described damping material of the wire mesh can be applied not only to the shell inner plate but also to the outlets of the communication pipes and the tail pipe, to prevent vibration. When punched metal is used for the shell inner plate, acoustical properties are produced in the shell wall.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust silencer for an internal combustion engine comprising:

a shell wall including a shell outer plate;

a shell inner plate; and a damping material inserted between the shell outer plate and the shell inner plate;

wherein the damping material is a single layer of a stretchably woven metal wire constructed into a woven metal mesh, the metal wire of the woven metal mesh having surface side portions (X), back side portions (Y), and bridging portions (B) extending between the surface side portions (X) and the back side portions (Y), the surface side portions (X) and the back side portions (Y) of the woven metal mesh contacting an inner surface of the shell outer plate and an outer surface of the shell inner plate, respectively, wherein the bridging portions (B) are oriented approximately in a direction orthogonal to a direction of each of the surface side portions (X) and the back side portions (Y) of the woven metal mesh.

2. The exhaust silencer for an internal combustion engine according to claim 1, wherein the metal wire is stainless steel wire.

3. The exhaust silencer for an internal combustion engine according to claim 1, wherein both the shell inner plate and the damping material of woven metal mesh are fabricated into cylindrical shapes, and the damping material of woven metal mesh is fabricated so that the surface side portions (X) are on an outer side of the woven metal mesh, and an inner diameter of the woven metal mesh is smaller than an outer diameter of the shell inner plate.

4. The exhaust silencer for an internal combustion engine according to claim 1, wherein the damping material is woven using a bundle of a plurality of metal wires.

5. The exhaust silencer for an internal combustion engine according to claim 1, wherein the shell inner plate includes an enlarged first end for mating with an inner surface of the shell outer plate and an enlarged distal end for mating with the inner surface of the shell outer plate with an intermediate portion extending therebetween.

6. The exhaust silencer for an internal combustion engine according to claim 5, wherein said damping material is positioned on at least a portion of said intermediate portion.

7. The exhaust silencer for an internal combustion engine according to claim 1, wherein the damping material is cylindrical and the woven metal mesh is stretchable in a diameter direction.

8. The exhaust silencer for an internal combustion engine according to claim 1, wherein a direction of metal wire of the woven metal mesh is slanted on the shell inner plate relative to a longitudinal direction of the exhaust silencer.

9. The exhaust silencer for an internal combustion engine according to claim 1, wherein the surface side portions (X) of the woven metal mesh make contact with the shell outer plate, and are oriented approximately in an axial direction of the shell for facilitating the positioning of the woven metal mesh on the shell inner plate.

10. The exhaust silencer for an internal combustion engine according to claim 1, wherein the back side portions (Y) of the woven metal mesh make contact with the shell inner plate, and are oriented approximately in a direction orthogonal to the axial direction of the shell for inhibiting the sliding of the woven metal mesh in the axial direction of the shell.

11. A shell for use in forming an exhaust silencer for an internal combustion engine comprising:

a shell outer wall;

a shell inner wall disposed within said shell outer wall; and a damping material inserted between the shell outer wall and the shell inner wall;

wherein the damping material is a single layer of a stretchably woven metal wire constructed into a woven metal mesh for providing a thermal-insulation between the shell outer wall and the shell inner wall, the metal wire of the woven metal mesh having surface side portions (X), back side portions (Y), and bridging portions (B) extending between the surface side portions (X) and the back side portions (Y), the surface side portions (X) and the back side portions (Y) of the woven metal mesh contacting an inner surface of the shell outer plate and an outer surface of the shell inner plate, respectively, wherein the bridging portions (B) are oriented approximately in a direction orthogonal to a direction of each of the surface side portions (X) and the back side portions (Y) of the woven metal mesh.

12. The shell for use in forming an exhaust silencer for an internal combustion engine according to claim 11, wherein the metal wire is stainless steel wire.

13. The shell for use in forming an exhaust silencer for an internal combustion engine according to claim 11, wherein both the shell inner wall and the damping material of woven metal mesh are fabricated into cylindrical shapes, and the damping material of woven metal mesh is fabricated so that the surface side portions (X) are on an outer side of the woven metal mesh, and an inner diameter of the woven metal mesh is smaller than an outer diameter of the shell inner wall.

14. The shell for use in forming an exhaust silencer for an internal combustion engine according to claim 11, wherein the damping material is woven using a bundle of a plurality of metal wires.

15. The shell for use in forming an exhaust silencer for an internal combustion engine according to claim 11, wherein the shell inner wall includes an enlarged first end for mating with an inner surface of the shell outer wall and an enlarged distal end for mating with the inner surface of the shell outer wall with an intermediate portion extending therebetween.

16. The shell for use in forming an exhaust silencer for an internal combustion engine according to claim 15, wherein said damping material is positioned on at least a portion of said intermediate portion.

17. The shell for use in forming an exhaust silencer for an internal combustion engine according to claim 11, wherein the damping material is cylindrical and the woven metal mesh is stretchable in a diameter direction thereof.

18. The shell for use in forming an exhaust silencer for an internal combustion engine according to claim 11, wherein a direction of metal wire of the woven metal mesh is slanted on the shell inner wall relative to a longitudinal direction of the exhaust silencer.

19. The shell for use in forming an exhaust silencer for an internal combustion engine according to claim 11, wherein the surface side portions (X) of the woven metal mesh make contact with the shell outer plate, and are oriented approximately in an axial direction of the shell for facilitating the positioning of the woven metal mesh on the shell inner plate.

20. The shell for use in forming an exhaust silencer for an internal combustion engine according to claim 11, wherein the back side portions (Y) of the mesh make contact with the shell inner plate, and are oriented approximately in a direction orthogonal to an axial direction of the shell for inhibiting the sliding of the woven metal mesh in the axial direction of the shell.

21. The shell for use in forming an exhaust silencer for an internal combustion engine according to claim 1, wherein each of the side surface portions (X) of the woven metal wire is substantially straight in shape, and each is aligned at an angle with respect to an inner surface of the outer shell plate.

22. The shell for use in forming an exhaust silencer for an internal combustion engine according to claim 1, wherein junctures of the bridging portions (B) and the surface side portions (X) of the woven metal mesh make contact with an inner surface of the shell outer plate, and the back side portions (Y) of the woven metal mesh make contact with an outer surface of the shell inner plate.

23. The shell for use in forming an exhaust silencer for an internal combustion engine according to claim 11, wherein each of the side surface portions (X) of the woven metal wire is substantially straight in shape, and each is aligned at an angle with respect to an inner surface of the outer shell plate.

24. The shell for use in forming an exhaust silencer for an internal combustion engine according to claim 11, wherein junctures of the bridging portions (B) and the surface side portions (X) of the woven metal mesh make contact with an inner surface of the shell outer plate, and the back side portions (Y) of the woven metal mesh make contact with an outer surface of the shell inner plate.

* * * * *